US006322262B1

(12) United States Patent
Trosterud

(10) Patent No.: US 6,322,262 B1
(45) **Date of Patent: *Nov. 27, 2001**

(54) SYSTEM FOR THE SALE OF PRINTED INFORMATION FROM AN AUTOMATIC VENDING MACHINE

(76) Inventor: Nils Chr. Trosterud, Strømsborgveien 37b, N-0287 Oslo (NO)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/486,589

(22) PCT Filed: Aug. 31, 1998

(86) PCT No.: PCT/NO98/00266

§ 371 Date: May 8, 2000

§ 102(e) Date: May 8, 2000

(87) PCT Pub. No.: WO99/12134

PCT Pub. Date: Mar. 11, 1999

(30) Foreign Application Priority Data

Sep. 1, 1997 (NO) ..... 974005

(51) Int. Cl.[7] ..... B41J 11/44; B41J 3/42
(52) U.S. Cl. ..... 400/70; 400/61; 400/76
(58) Field of Search ..... 400/70, 76, 61

(56) References Cited

U.S. PATENT DOCUMENTS

| | | | | |
|---|---|---|---|---|
| Re. 32,115 | | 4/1986 | Lockwood et al. . | |
| 4,412,292 | | 10/1983 | Sedam et al. . | |
| 5,091,713 | | 2/1992 | Horne et al. . | |
| 5,630,103 | | 5/1997 | Smith et al. . | |
| 5,835,923 | * | 11/1998 | Shibata et al. | 707/526 |
| 5,845,262 | * | 12/1998 | Nozue et al. | 705/26 |
| 5,845,577 | | 12/1998 | Nelson et al. . | |
| 5,860,362 | * | 1/1999 | Smith | 101/494 |
| 5,884,140 | * | 3/1999 | Ishizaki et al. | 455/2 |
| 6,012,890 | * | 1/2000 | Celorio Garrido | 412/19 |

FOREIGN PATENT DOCUMENTS

| | | |
|---|---|---|
| 0535630 A2 | 4/1993 | (EP) . |
| 0829832 A2 | 2/1998 | (EP) . |
| WO 9202888 | 2/1992 | (WO) . |
| WO 9429820 | 12/1994 | (WO) . |
| WO 9730425 | 8/1997 | (WO) . |

OTHER PUBLICATIONS

P.E. Dyson et al., "Electronic Delivery Without the Internet," vol. 25, No. 1, The Seybold Report on Publishing Systems, pp. 19–20.

A. Tribute et al., "Scitex PressPoint moves forward," Seybold Report on Publishing Systems, vol. 25, No. 6, pp. 3(29), Nov. 30, 1995.

PressPoint—The Global Newspaper Distribution System, web address http://www.presspoint.com/.

* cited by examiner

*Primary Examiner*—John S. Hilten
*Assistant Examiner*—Charles H. Nolan, Jr.
(74) *Attorney, Agent, or Firm*—Young & Thompson

(57) ABSTRACT

A system for the sale of printed information from an automatic vending machine, information being transmitted from a central source via a network interface to one or more vending machines, each provided with an information processing unit which separates the information data into a display portion and a print portion, a display device, a high-speed printer for local printing of the desired publication, a replaceable paper magazine, a folding/cutting unit having built-in stapling, a covered drawer into which the publication is dispensed, a unit for registering and receiving payment in the form of a coin slot or card reader, and a set of push buttons by means of which the customer can make a choice.

14 Claims, 3 Drawing Sheets

SYSTEM FOR THE SALE OF PRINTED INFORMATION FROM AN AUTOMATIC VENDING MACHINE

BACKGROUND OF THE INVENTION

The invention relates to a system for the sale of printed information from an automatic vending machine.

The vending machine is to prepare directly printed information, such as newspapers, bulletins, brochures and so forth.

The information is transmitted on-line from a central editorial office to the vending machine and in updated continuously 24 hours a day, so that the vending machine always prints the latest news, the latest update of indexes, results and so forth.

DESCRIPTION OF THE RELATED ART

The basis for the invention is the need for a new type of distribution of printed information and news material. Today, the distribution and publication of news material can assume different forms. The actual raw material—the news—is produced according to conventional journalistic methods, but is then processed and distributed in different ways. There is a distinction between the broadcasting media and the printed media, with Internet as a category of its own.

In news distribution via the broadcasting media, the news or information is presented via radio or television. This presupposes that the recipient has the necessary equipment to receive the transmissions, and is able to hear or view them with the aid of a radio or television set. The advantage of this is a rapid distribution of the news material, but the disadvantage is that the recipient must be in the vicinity of an apparatus which makes it possible to hear or view what is being presented. Moreover, it is not possible for the recipient himself to choose the time he would like the news to be presented.

In the case of news distribution via the Internet a number of the same advantages and disadvantages assert themselves. There is the advantage of swift distribution, but the recipient must be in possession of a possible Internet connection and an expensive PC to be able to make use of the information. For the time being this puts clear limitations to the size of the recipient group.

News distribution via the printed media is rooted in hundreds of years of tradition, but has not changed substantially in form during this period. The information is still processed and transferred to a central printing press, printed, folded, stapled and then manually distributed via motor vehicle, railway, aeroplane etc. to points of sale or delivered to subscribers. A major disadvantage of this is that the distribution takes time, so that the information is old before it reaches the reader. In addition, it is not financially viable to print and distribute news continuously in order to keep the information up-to-date.

The printed media therefore experiences ever-growing competition from the broadcasting media, which has a more dynamic distribution. In the advertising market the broadcasting media also have advantages in that commercials can be presented at different times and in connection with programmes which are directed towards the target groups the advertiser wishes to reach. Because of this, the printed media has a shrinking market share of the total number of advertisements.

Owing to the distribution method, there are daily large amounts of returns and unneccessary consumption of paper because it is only possible to estimate roughly the number of copies which will be sold in the course of a sales day or period.

SUMMARY OF THE INVENTION

It is an objective of the invention to provide the possibility of an entirely new type of distribution of printed information and news material, and enable the publisher to compete with the broadcasting media. In some areas this form of distribution will in addition provide unique opportunities which cannot be obtained by using any other method.

In the following, some publications will be mentioned that encompasses the technology which the present invention is based upon.

P. E. Dyson et al: <<Electronic delivery without the Internet>>, Seybold Report on Publishing Systems, Vol. 25, No.1, Sep. 1, 1995, describes a system called PressPoint, which is based on electronic distribution of newspapers. The system consists of a network of central units, which via suitable communication channels gather data that represent daily issues of a number of newspapers. A satellite system transfers data from the central units to a large number of vending machines. Each vending machine contains, among other things, receiving equipment, means of payment, means of selecting the desired newspaper and a high speed printer.

However, no system for two-way communication between the central units and the vending machines is described. Thereby, an editorial office will not receive continuous reports about the sales figures from the different machines, and will not be able to adapt their publications accordingly. In addition, there is no description of presenting the different publications as a specially adapted on-screen image on the vending machine.

Finally, the above-mentioned publication describes only the purchase of an entire publication. It is not possible for a customer to choose only the parts of the publication that he finds most interesting.

U.S. Pat. No. 5,465,213 describes the production of books from a vending machine located in a building. The patent contains some features of resemblance with the present invention, but at the same time is very different in principle, structure and intention.

The U.S. patent further requires the machine to be located at a sales outlet, library or the like, and is based on one or more operators having to assist in ordering the individual book from the machine or in having it issued to the customer. Nor is the system based on the book being printed in the same vending machine as that from which the customer places his order, but in a central machine. The vending machines from which the customer orders books are spread out in the building and are connected to the central machine via a network.

U.S. Pat. No. 5,465,213 is based on storing tens of thousands of books, i.e., the textual content and separate colour covers, together with written and graphic sales information about each one of the stored books.

The objective of the present invention, on the other hand, is to store only the most recently updated variant of the newspaper or magazine pages which are transmitted to the vending machine, with text and pictures in the same document.

When a book is to be printed, the pages of text are printed by a laser printer and the cover by a colour printer—in other words, text and pictures separately and not in one and the same document and on the same sheet as is the objective of the present invention.

In the vending machine of the US publication the customer must wait three to five minutes for the print-out of the desired information, whilst with the present invention it will only take seconds.

The connection to the telecommunications network via modem is intended to be used for registration or checking of payment by credit card, or for connection to other similar machines where other books are stored so that there is also the possibility of having these printed out. Here, there is no dynamic, on-line updating of the information as is presumed in the present invention. On the contrary, the system is based on static storage of books whose content will not be changed.

The U.S. patent is not devised for the transmission and input of data via the telecommunications network, but contains a description of the possibility thereof. In such cases, an operator must manually insert necessary disks and carry out necessary entering and checking of the data.

U.S. Pat. No. 5,630,103 describes the transmission of data via FM radio frequencies, for viewing on the recipient's own PC or for printing on the recipient's printer. The patent relates only to the actual data transmission, not the printing or updating of the information. The data transmission in the U.S. patent is also presumed to be carried out in a different way than is the objective of the present invention, which is based on a modem and a telecommunications network.

PCT Patent No. PCT/NL94/00136 describes a vending machine for printing out a section of a map. It is not apparent from the from the documentation that there is a connection between the vending machine and the outside world. The vending machine prints only maps, no other information.

It is an objective of the present invention to avoid the disadvantages of the previously known devices and at the same time create a simple, competitive and public-friendly newspaper, magazine, news presentation, etc.

The above mentioned is provided by means of a system, of the type mentioned in the introduction.

The invention will be described in more detail below, with reference to the drawings, wherein:

DESCRIPTION OF THE PREFERRED EMBODIMENTS

The invention takes as its point of departure that a central editorial office produces news material continuously, as all major newspaper editorial offices, news agencies and radio and television stations do. Ready-written articles and digitised pictures are entered in a PC in the layout program of the editorial office, and pages are laid out as in a regular newspaper.

However, instead of being sent for press-technical production, the pages are transmitted via modem to a number of coin-operated vending machines which are placed at central locations frequented by a large public. The vending machines are in two-way on-line connection with the editorial office.

As the news picture changes, an event occurs, a result is final, share prices change or the like, the newspaper pages are updated immediately by entering the new information on the pages. Such changes can be carried out at any time of the day or night, at intervals of seconds, if so desired. Each single change is transmitted to the vending machine, which thus at any given time can supply updated information, text, pictures, charts, tables and so forth.

Figure 1:
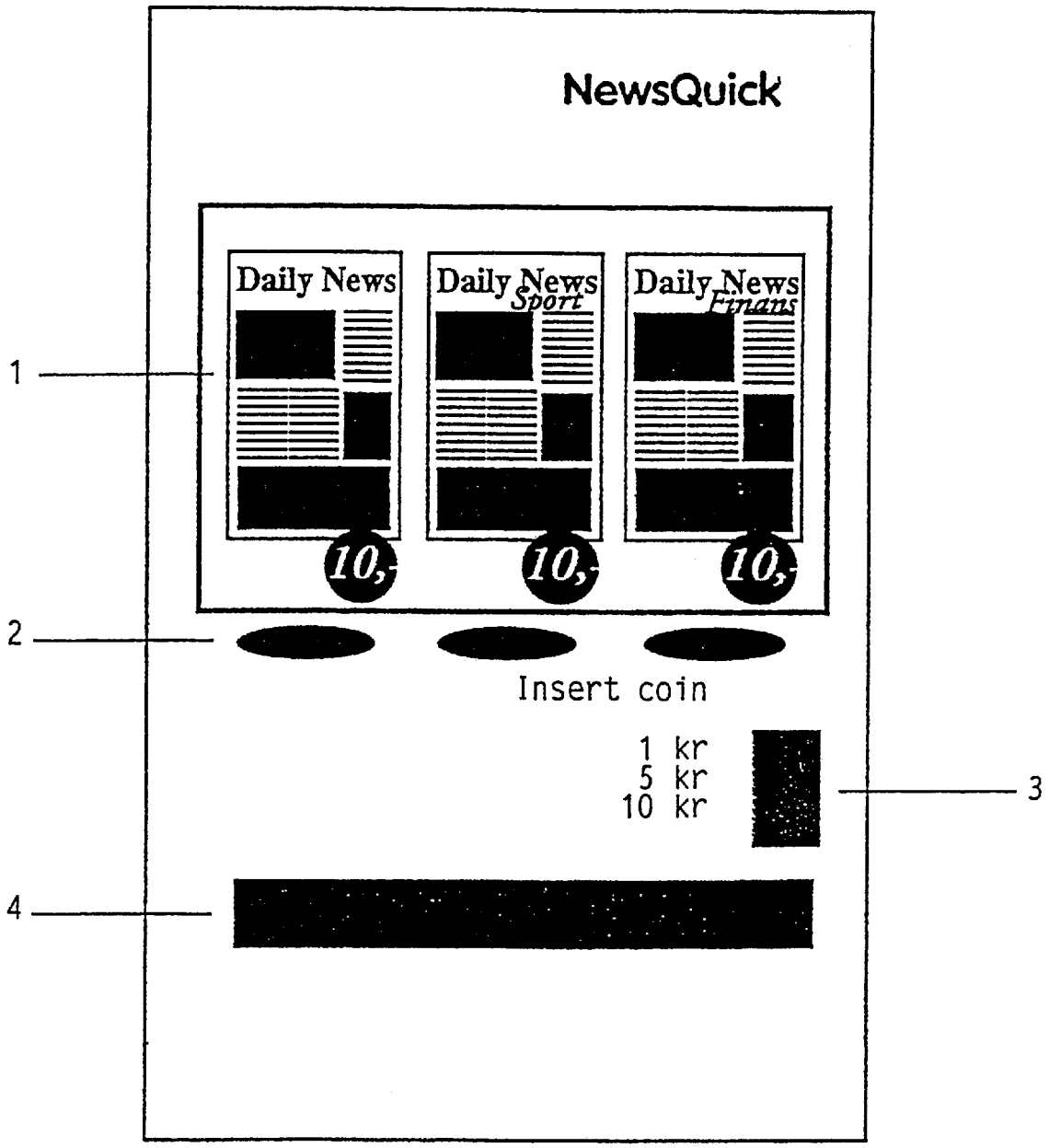
FIG. 1 is a schematic front view of an example of an automatic vending machine.
Figure 2:
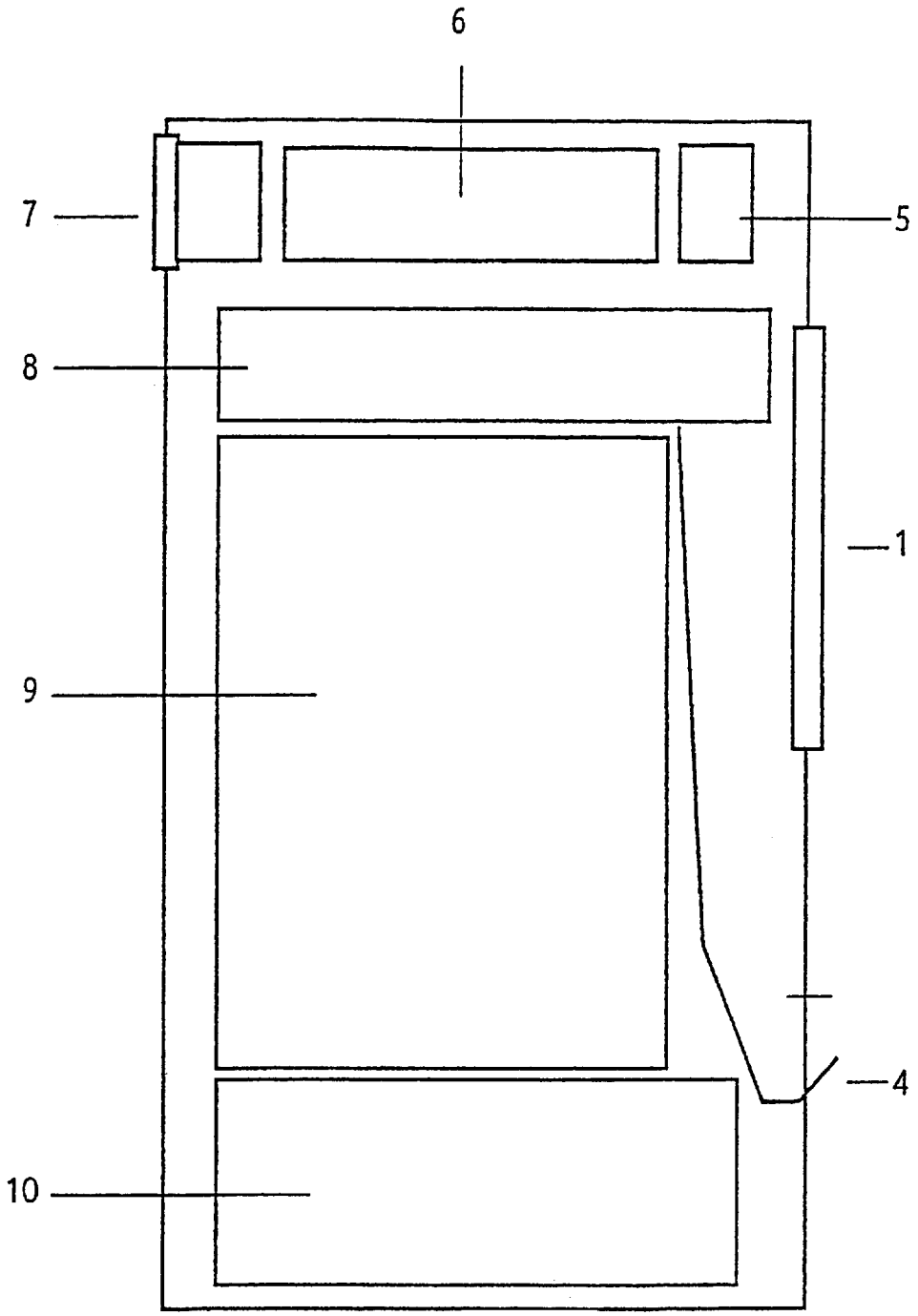
FIG. 2 is a schematic cut-away lateral view of the vending machine.
Figure 3:
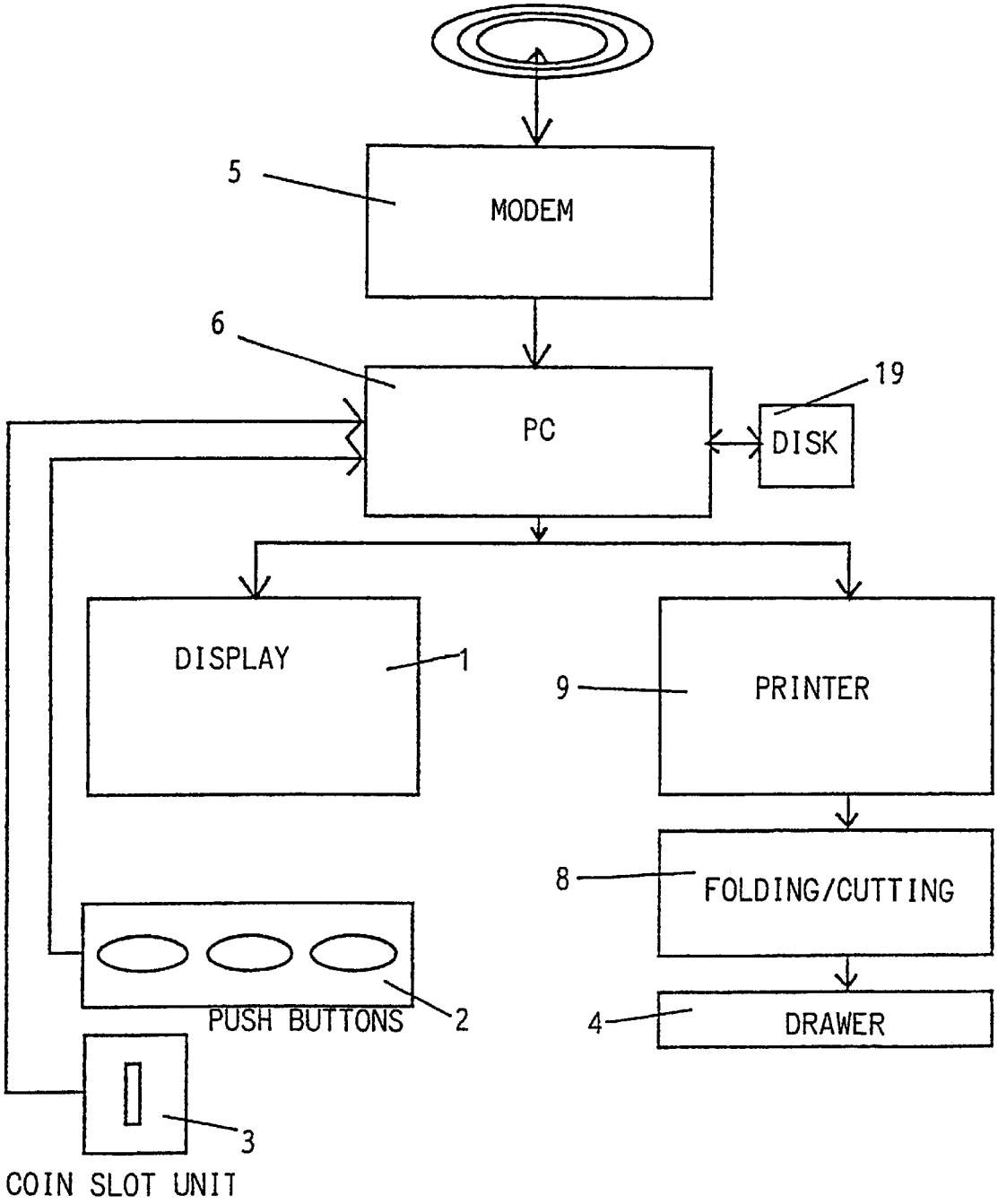
FIG. 3 is a schematic illustration of in block diagram form of the principles of the vending machine.

The vending machines contain a large display means 1 (cf FIGS. 1 and 3) which can display the first page of one or more newspapers or publications at the same time. The front pages are updated as new information is transmitted to the vending machine. It is also possible to enter live picture, display animations etc. in order to attract attention. The public may thus choose one or more of the publications on display, pay using the coin slot 3 whereupon the vending machine immediately prints, folds, cuts and delivers one or more finished publications.

This has obvious advantages for the publisher. Usually, it will be necessary to print and distribute a newspaper publication which meets the wishes of the public in the broadest manner possible. Instead, in these vending machines it is possible to divide the information into desired sections, e.g. a pire newspaper, a sports paper and a financial paper. The purchaser may thus choose the sections which are of interest, and buy only these. The contents of each section will also vary during the course of 24 hours, as the news occurs. The publisher may thus achieve two things: that the purchasers put together several sections and so pay in total more than for a normal newspaper from a news stand, and that the product is bought several times in the course of 24 hours.

A second advantage, unique to the invention, is that the contents of the newspapers may be different in different geographical areas. An event in a district is usually of greater local interest than an event in the capital city. The publisher can therefore divide the vending machines into geographical areas, and give greater emphasis to local information when events of obvious local interest occur. This is particularly advantageous for publishers who have local offices.

The publisher will also obtain advantages through access to a completely new advertising market. It will thereby be possible to offer advertisers advertisement insertions that will reach a guaranteed number of readers, as the vending machines on-line count the number of copies sold. When a desired number of the advertisement have been printed, it is automatically deleted and replaced by another advertisement. In this way, it is also possible to insert an advertisement for an exact period of time, e.g. advertisements with time-limited offers or the like, or just within certain limited geographical areas. All combinations of these are also possible. This thus results in a highly competitive alternative to radio and television advertising.

No other known technology allows similar possibilities. Only U.S. Pat. No. 5,465,213 touches upon parts of this concept. However, the patent relates to the production of books having only textual content and a separate cover, and does not provide the technical possibility of producing newspapers or magazines containing a mixture of text, graphics, tables and illustrations. Among other things, nor are the books printed in the same vending machine as that from which members of the public make their choice, and the information that is printed is not dynamically updated as in the vending machine according to the present invention.

The function of the system will be described in more detail below, with reference to the drawings. Data is received in the vending machine via a high-speed two-way modem 5, either via the regular telecommunications network, ISDN, GSM or another form of teletransmission or data transmission. The data is then transmitted to a PC 6 in the vending machine, which separates the data into a display device portion and a print portion. The display device portion is transmitted to the display device 1, which shows the first page of each publication, or alternatively other information that the editorial office—understood to include also the publisher or information supplier—chooses to present on the display device. Fairly simple, standard animation programs or especially developed software ensures that the desired information is presented on the display device 1, and that the editorial office may change, check and update the screen images via two-way communication. As an automated presentation form, it is also possible to choose to show only the relevant, most recently updated first pages at any given time.

The display device 1 may be a standard LCD screen or computer monitor.

The printed data is ready-rasterised and separated as it is transmitted to the vending machine. This process takes place centrally at the editorial office prior to the transmission via modem. The process takes place in a server, with the aid of either standard software or specially developed software, and takes very little time with today's computing power. In this way, the information is ready for printing the instant the data has been transmitted to the machine. As an extra safeguard, the most recently updated information is stored on a high-speed hard disk 19 in the vending machine PC 6.

The print data is transferred to a high-speed printer having sufficiently large format to print the desired publication on one or more sheets, alternatively from rolls, which are in a replaceable paper magazine 10. According to the publisher's choice, the printer may provide print options of one or more colours, one or two-sided copies, of the type digital offset, laser, ink, toner-based or similar. However, the system is preferably based on two or four colours.

The printing process is as far as possible carried out so that the shortest time possible passes from the purchaser choosing the information he would like until it is printed. All rasterising, warming up and so forth should have been carried out before the last part of the printing process starts so that the shortest time possible passes from the purchaser choosing a desired publication to it being ready-printed.

The customer pays as required via the coin slot 3. The slot is of a conventional commercial type, adapted to the coins in the various markets. The payment is registered, and the customer can choose a desired variant from the push buttons on the front 2 of the machine. Once the choice has been made the printing process starts immediately via the printer. Of course, payment could also be made via a card reader, if so desired.

Once the sheets have been printed, they pass to a folding/cutting unit 8, optionally having built-in stapling. After processing in this unit, the publication is released or pushed into a covered drawer of the front 4 of the machine. The entire process from customer initiation of the printing to a ready printed publication is carried out in seconds.

The vending machine also registers the number of printed copies, as well as the time of printing. This data is transmitted continuously to the editorial office, and processed in a statistics program which can show the total number of printed copies at any time, optionally in a geographical break-down, if so desired, statistics with respect to the times of the day having most traffic for all vending machines in the network or per vending machine. A counter in the vending machine gives advance warning in plenty of time when the paper cassette must be replaced.

The vending machine may also have a bulit-in alarm against break-ins and/or sabotage and damage, which warns the editorial office or another chosen recipient via modem. All reports of faults from the vending machine with respect to a full coin unit, coins that are stuck, paper malfunctions, power cuts etc. may also be reported to a chosen recipient via modem.

When the vending machine receives updated information from the editorial office, a new and updated image is shown immediately on the display device. It may take a few seconds for the vending machine to prepare the new information for printing, and to cancel the earlier version. If so, a message to that effect is given on the display device.

The vending machine may also have a built-in fan and ventilation system 7 to regulate temperature, condensation etc. to avoid problems with the paper, malfunctions in the electronics and so forth.

What is claimed is:

1. A system for the sale of printed information from an automatic vending machine, comprising:

a central information source;

a data network;

a vending machine in two-way communication via the data network with the central information source, the vending machine having an information processing unit, a display device, selection buttons, a unit for registering and receiving payment, and a printing unit, the vending machine being arranged to transmit vending machine information to the central information source, and the central information source configured to transmit display device information and print information to the vending machine and to receive the vending machine information sent by the vending machine, wherein the vending machine printing unit comprises a print counter arranged to count the number of copies of a first advertisement insertion which has been sold and printed at the vending machine, the vending machine being adapted to send the count of the number of first advertisement copies printed to the central information source, and the central information source being adapted to, upon receiving the count of the number of first advertisement copies printed and determining that the count exceeds a predetermined number, instruct the vending machine to delete the first advertisement and to begin printing a second advertisement.

2. The system of claim 1, wherein the central information source is adapted to transmit to the vending machine joint data comprising a display device portion joint with a print portion.

3. The system of claim 2, wherein the joint data received by the vending machine is separated into the display device portion and the print portion, the display device portion being transmitted the display device and the print portion to the printing unit.

4. The system of claim 3, wherein the print data is ready-rasterized and received ready for printing by the vending machine.

5. The system of claim 1, wherein the vending machine registers the number of printed copies and the time of printing as data for transmission to the central information source.

6. The system of claim 3, wherein the central information source is adapted to transmit the print portion in sections so that the vending machine may, upon selection by the selection buttons, selectively print sections of the transmitted print portion.

7. The system of claim 3, wherein the central information source is adapted to selectively transmit the display device portion to correspond to a front page of a paper and other information decided upon by the central information source.

8. The system of claim 1, wherein, the vending machine is adapted to transfer information to the central information source containing paper supply data.

9. The system of claim 1, wherein, the vending machine is adapted to transfer information to the central information source containing burglary and damage data.

10. The system of claim 1, wherein, the vending machine is adapted to jointly receive from the central information source the display device information and print information, and upon such receipt to separate the print information from the display device information and transfer the print information to a high-speed printer with a paper roll located on a replaceable paper magazine.

11. The system of claim 1, wherein the printing unit comprises multi-color output and multi-sided print output.

12. The system of claim 11, wherein the printing unit is operatively connected to a cutting/folding unit, the cutting/folding unit connected to a covered drawer on the front of the vending machine.

13. The system of claim 1, wherein the unit for registering and receiving payment is a coin slot unit and operatively connected to the selection buttons.

14. The system of claim 1, wherein the unit for registering and receiving payment is a card reader.

* * * * *